US009295313B2

(12) United States Patent
Kinskey et al.

(10) Patent No.: US 9,295,313 B2
(45) Date of Patent: Mar. 29, 2016

(54) SKID PLATE FOR HANDLE

(71) Applicant: LF Centennial Ltd., Road Town, Tortola (VG)

(72) Inventors: Terrence P. Kinskey, Alpharetta, GA (US); Matthew G. Williams, Lighthouse Point, FL (US)

(73) Assignee: LF CENTENNIAL LTD, Road Town, Tortola (VG)

( * ) Notice: Subject to any disclaimer, the term of this patent is extended or adjusted under 35 U.S.C. 154(b) by 293 days.

(21) Appl. No.: 13/719,900

(22) Filed: Dec. 19, 2012

(65) Prior Publication Data

US 2013/0161143 A1 Jun. 27, 2013

Related U.S. Application Data

(60) Provisional application No. 61/578,670, filed on Dec. 21, 2011.

(51) Int. Cl.
*A45C 5/14* (2006.01)
*A45C 13/26* (2006.01)

(52) U.S. Cl.
CPC ..... *A45C 13/262* (2013.01); *A45C 5/14* (2013.01); *Y10T 16/451* (2015.01); *Y10T 29/49826* (2015.01)

(58) Field of Classification Search
CPC ..... A45C 5/14; A45C 13/262; A45C 5/146; A45C 13/385; A45C 3/004
USPC ..... 190/18 R, 18 A, 115; 280/47.26, 47.17, 280/655, 47.27; 16/113.1
See application file for complete search history.

(56) References Cited

U.S. PATENT DOCUMENTS

| | | | | |
|---|---|---|---|---|
| 5,590,748 | A * | 1/1997 | Chang | A45C 13/262 16/113.1 |
| 5,943,936 | A * | 8/1999 | Deliman | A45C 13/262 16/113.1 |
| 6,918,474 | B2 * | 7/2005 | Nykoluk | A45C 5/14 16/113.1 |
| 7,775,334 | B2 * | 8/2010 | Drew | A45C 5/14 190/108 |
| 8,534,434 | B2 * | 9/2013 | Crull | A45C 13/26 16/113.1 |

* cited by examiner

*Primary Examiner* — Fenn Mathew
*Assistant Examiner* — Cynthia Collado
(74) *Attorney, Agent, or Firm* — Duane Morris LLP; J. Rodman Steele, Jr.; Gregory M. Lefkowitz

(57) ABSTRACT

A skid plate for protecting a telescoping handle is described. The skid plate can include a cover body with a back section, a first sidewall section and a second sidewall section, and the cover body can define concave cavity to enclose therein portions of a telescoping base of the telescoping handle. The cover body can also include a plurality of spaced apart engagement members extending from the inner side of the cover body for engaging with the telescoping base. The plurality of engagement members can include attachment members and spacing members.

20 Claims, 9 Drawing Sheets

SKID PLATE FOR HANDLE

CROSS-REFERENCE TO RELATED APPLICATIONS

The application claims priority to U.S. Provisional Application No. 61/578,670, filed Dec. 21, 2011, the entirety of which is incorporated herein by reference.

FIELD OF THE INVENTION

The present invention relates generally to a protector for telescoping handles, and more particularly to a skid plate for telescoping handles on rolling containers.

BACKGROUND

Portable containers, such as rolling bags and dollys, are known to be useful for the storage, organization, and transport of items from site to site for a wide range of personal, leisure and business purposes. Telescoping handles and wheels on these containers facilitate easy transport, especially for heavy loads. While these rolling containers and others of the prior art are useful in some instances, there are still numerous deficiencies and the potential for more useful rolling containers and rolling container features.

SUMMARY OF THE INVENTION

A rolling container that includes a container body, at least one wheel, a telescoping handle, and a skid plate for the telescoping handle is described. The container body can include a bottom support and a back support. The at least one wheel can be attached to the container body proximate at least one of the bottom support and back support. The telescoping handle can be attached to at least a portion of the back support. The skid plate can include a cover body and a plurality of engagement members. The cover body can include a back section, a first sidewall section and a second sidewall section. The cover body can define a concave cavity to enclose therein portions of a telescoping base of the telescoping handle. The plurality of engagement members can extend from an inner side of the cover body for engaging with the telescoping base.

The plurality of engagement members can be coupled to the first and second sidewall sections of the cover body. The plurality of engagement members can be coupled to the back section of the cover body.

The plurality of engagement members can include at least one attachment member for securing the cover body to the telescoping base and at least one spacing member for providing a space between the telescoping base and the back section of the inner side of the cover body.

The at least one spacing member can be coupled to the back section of the cover body. The at least one attachment member can be coupled to the first and second sidewall sections of the cover body. In some embodiments, the at least one attachment member can also include a first attachment member and a second attachment member; the first and second attachment members can be spaced apart; and the at least one spacing member can be disposed between the first and second attachment members.

The at least one spacing member can also be coupled to the back section of the cover body, and the at least one attachment member can be coupled to the at least one spacing member.

The rolling container can also include a handle mount for attaching the telescoping base to the back support of the container body, and the cover body can enclose portions of the handle mount. The cover body can also include notches in the sidewall sections of the cover body for receiving portions of the handle mount. The cover body can also include a bottom wall configured to cover a bottom side of the handle mount and/or telescoping base.

The rolling container can also include an upper handle mount and a lower handle mount for attaching the telescoping base to the back support of the container body. The cover body can extend from a bottom side of the upper handle mount to a bottom side of the lower handle mount and can enclose a portion of the lower handle mount. The plurality of engagement members can include attachment members for securing the cover body to the telescoping base and spacing members forming a slope and providing a space between the telescoping base and the back section of the inner side of the cover body.

A skid plate for protecting a telescoping handle is also described herein. The skip plate includes a cover body and a plurality of engagement members. The cover body includes a back section, a first sidewall section and a second sidewall section, and the cover body can define a concave cavity to enclose therein portions of a telescoping base of a telescoping handle. The plurality of engagement members can extend from the inner side of the cover body for engaging with a telescoping base.

The plurality of engagement members can include a first clip and a second clip forming a slope relative to the cover body. The first clip can include a first clip base coextensive with the back section of the cover body and a first set of prongs extending from the first clip base for securing the cover body to a telescoping base. The second clip can include a second clip base coupled to the back section of the cover body and a second set of prongs extending from the second clip base for securing the cover body to a telescoping base. The plurality of engagement members can also include a third clip with a third clip base coupled to the back section and a third set of prongs extending from the third clip base. The second clip can be disposed below the first clip and the third clip can be disposed below the second clip. The third clip base can extend from the inner side of the cover body further than the second clip base.

A cross-section of the cover body can also be curvilinear. A cross-section of the cover body can also be rectilinear. A lateral cross-section of the cover body can be curvilinear or rectilinear.

A method of protecting a telescoping handle is also described herein. The method includes the steps of providing a telescoping handle including a telescoping base; providing a skid plate including a back section, a first sidewall section and a second sidewall section and defining a concave cavity to enclose therein portions of a telescoping base of a telescoping handle; and attaching the skid plate to the telescoping handle, such that an inner side of the cover body engages with the telescoping base.

In some embodiments, a telescoping base can be connected to a container via an upper handle mount and a lower handle mount; and the step of attaching the skid plate to the telescoping handle can also include attaching the skid plate below the upper handle mount and enclosing at least a portion of the lower handle mount within the skid plate.

The skid plate can also include a plurality of engagement members extending from the inner side of the cover body. In such embodiments, the step of attaching the skid plate to the telescoping handle can include engaging the plurality of engagement members with the telescoping base.

The plurality of engagement members can also include at least two attachment members for securing the cover body to the telescoping base and at least one spacing member forming a slope and providing a space between the telescoping base and container. In such embodiments, the step of attaching the skid plate to the telescoping handle can also include engaging one of the attachment members with the telescoping base proximate to a bottom side of the upper handle mount, engaging another of the attachment members with the telescoping base proximate to a top side of the lower handle mount, and enclosing at least a portion of the lower handle mount with the cover body.

These and other features, objects and advantages of the present invention will become more apparent to one skilled in the art from the following description and claims when read in light of the accompanying drawings.

DETAILED DESCRIPTION

As shown in FIGS. 1-11, a skid plate for a telescoping handle is described. Although the following includes a description of the skid plate in the context of a telescoping handle for a rolling container, it is recognized that the skid plate can also be used with other devices with an exposed handle that may be damaged.

Figure 1A:
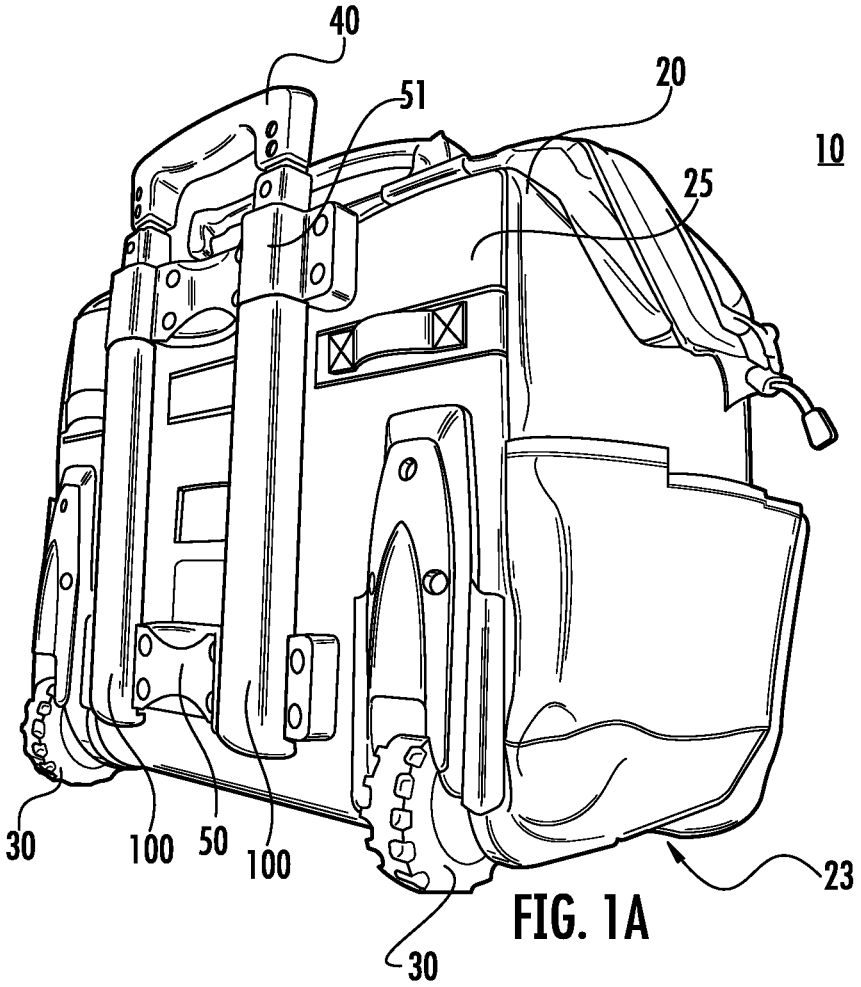
FIG. 1A is a perspective view of a rolling container with a pair of skid plates as described herein.

As used herein, the terms "upper," "lower," "bottom" and other terms of orientation refer the sides, ends or direction of the rolling container and/or skid plate when the container rests on its bottom support 23 with the skid plate 100 in a vertical orientation as depicted in FIG. 1A.

Figure 1B:
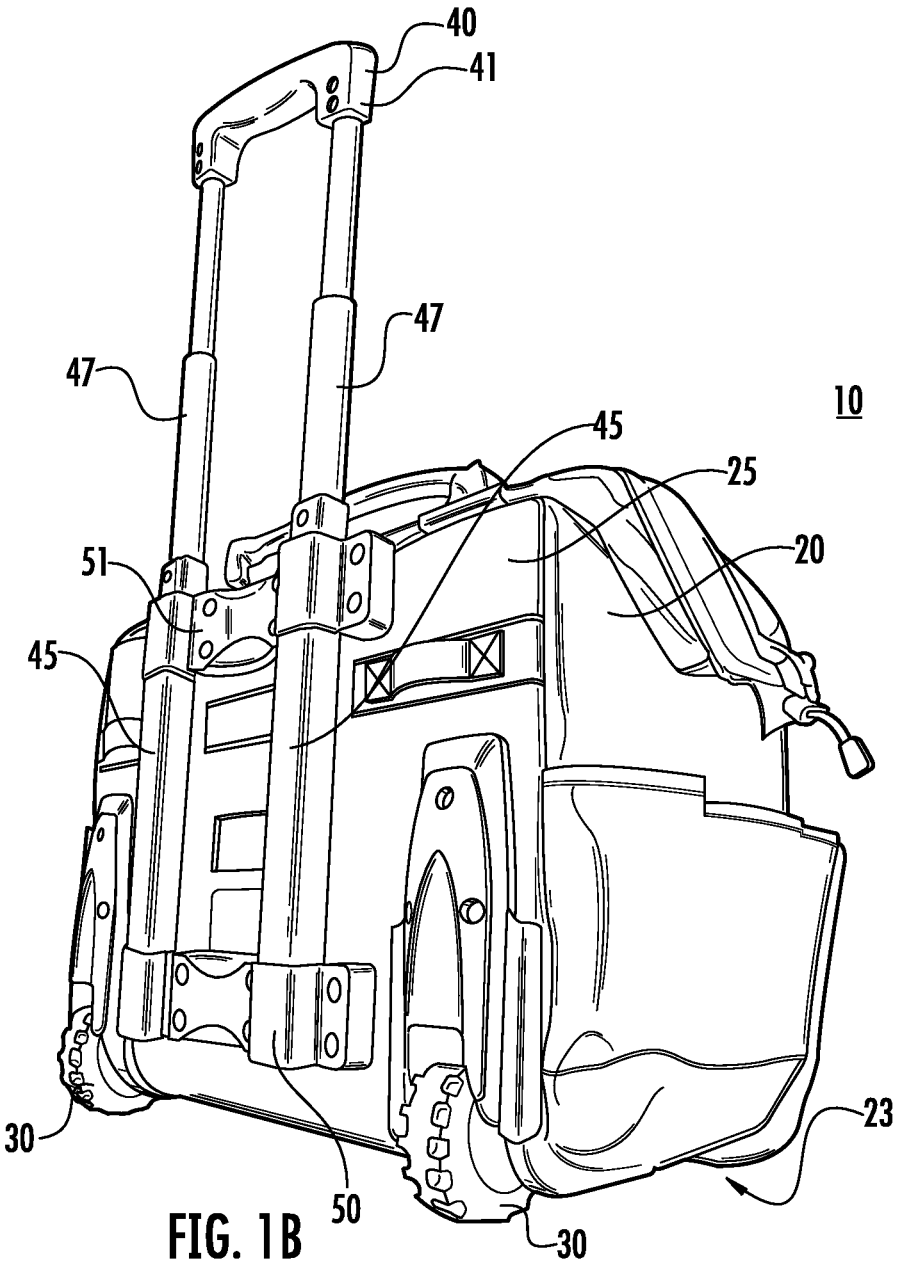
FIG. 1B is a perspective view of the rolling bag of FIG. 1A with the skid plates removed and the handle in an extended position.

As shown in FIGS. 1A and 1B, a rolling container 10 can include a container body 20, at least one wheel 30, and a telescoping handle 40. An used herein, the term "container" refers to a device that contains or can contain items for storage, transport and/or access. For example, containers can include bags, boxes, hand carts, and dollys. The container body 20 can include at least a bottom support 23 and a back support 25. In some embodiments, the container body 20 can also include a plurality of additional container sidewalls, defining a compartment in which items can be contained. For example, as shown in FIG. 1A, the container body 20 can form an open-topped storage compartment including a bottom support 23, a back support 25, a front container wall, two side container walls, and a closeable top. The at least one wheel 30, or preferably two wheels 30, can be positioned to allow the container body 20 to roll when force is exerted on the handle 40. In an exemplary arrangement, the wheels 30 can be attached to the container body 20 proximate the bottom support 23, the back support 25, or both 23, 25.

The telescoping handle 40 can include at least one telescoping base 45, at least one telescoping element 47 configured to retract within said telescoping base 45, and a handle 41 coupled to the at least one telescoping element 47. The handle 41 can also be coupled to a pair of telescoping bases 45 and a pair of telescoping elements 47. The telescoping handle 40 can also include a plurality of nested, telescoping elements 47 configured to retract within the telescoping base 45. FIG. 1A shows the telescoping handle 40 in a lowered position, in which the telescoping elements 47 are retracted within the telescoping base 45. FIG. 1B shows the telescoping handle 40 in a raised position, in which the telescoping elements 47 are extended from the telescoping bases 45. The telescoping handle 40 can be attached to the container body 20 in any suitable position, for example the telescoping handle 40 can be attached to the back support 25 and/or the bottom support 23. The telescoping base(s) 45 of the telescoping handle 40 can also extend along at least a portion on the back support 25 of the container body 20.

In one embodiment, the telescoping handle 40 can be attached to the container body 20 with at least one handle mount 50, 51. In other embodiments, the telescoping handle 40 can be attached to the container body 20 with a lower handle mount 50 and an upper handle mount 51. The lower handle mount 50 can be attached to a lower portion of the container body 20, such as a lower portion of the back support 25. The upper handle mount 51 can be attached to an upper portion of the container body 20, such as an upper portion of the back support 25. The handle mounts 50, 51 can secure the telescoping base 45 of the telescoping handle 40.

Because the telescoping elements 47 of the telescoping handle 40 retract and nest within the telescoping base 45, deformation or other damage to the telescoping base 45 can impede the functioning of the telescoping handle 40. For example, if the telescoping base 45 is dented or bent, the telescoping elements 47 may no longer extend/retract properly or may no longer fit within the telescoping base 45. The skid plate 100 described herein enables users to drag the container over impediments, such as curbs and stairs, without damaging relevant portions of the telescoping base 45 and telescoping elements 47.

Figure 2:
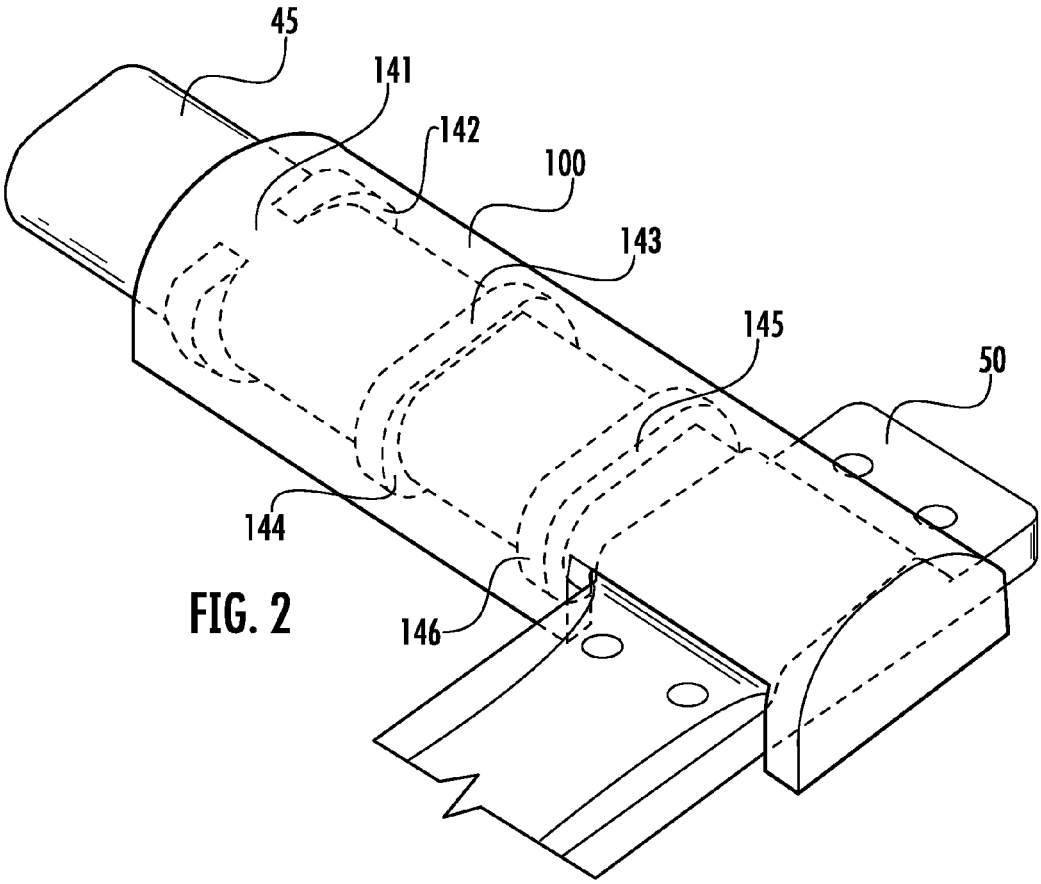
FIG. 2 is a partial transparency view of a skid plate described herein engaging with a portion of a telescoping base.
Figure 3:
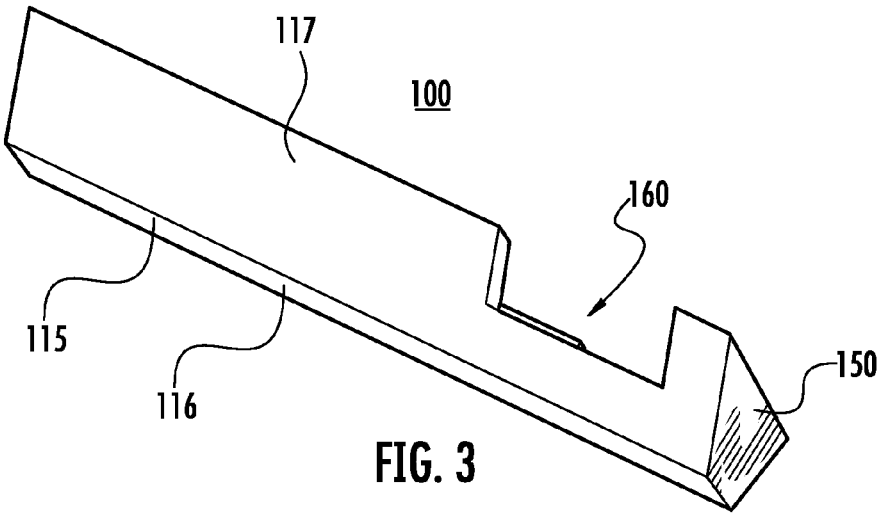
FIG. 3 is a perspective view of an outer side of another skid plate described herein.
Figure 4:
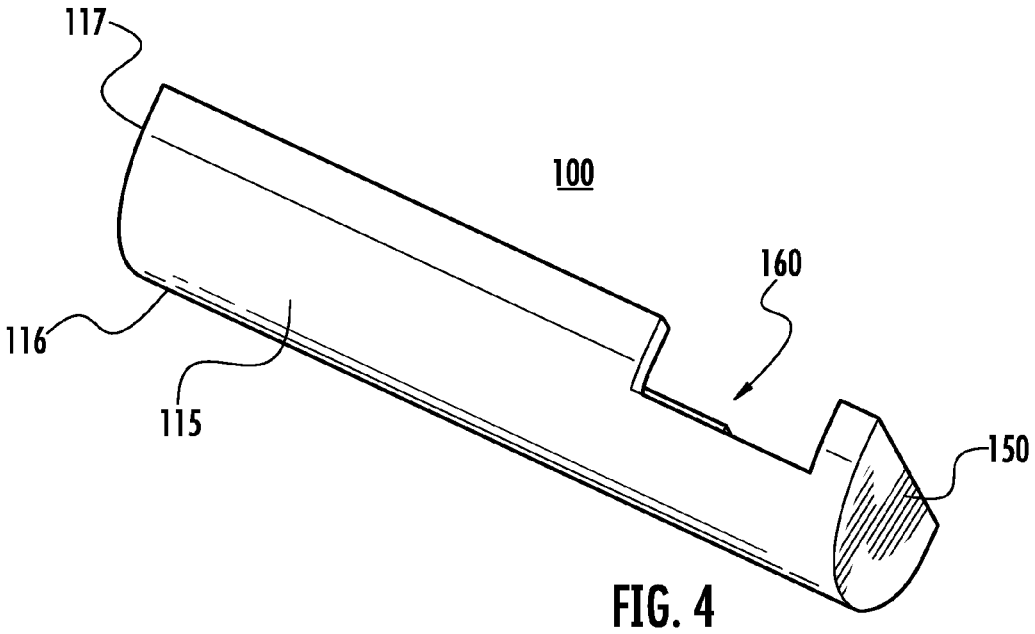
FIG. 4 is a perspective view of an outer side of another skid plate described herein.

As shown in FIGS. 2-11, the skid plate 100 includes a cover body 115 with a back section 116, a first sidewall section 117 and a second sidewall section 118. The cover body 115 can define a concave cavity to enclose therein portions of the telescoping base 45. FIG. 2 shows an exemplary arrangement of the skid plate 100 enclosing a portion of a telescoping base 45. In one arrangement as shown in FIG. 3, a lateral cross-section of the cover body 115 can be rectilinear. The cover body 115 can include a back wall 116 and at least two side walls 117, 118 forming any of a partial-square, partial-rectangle, partial-trapezoid, and partial polygon lateral cross-sections. In another arrangement, as shown in FIGS. 2 and 4, a lateral cross-section of the cover body 115 can be curvilinear. The cover body 115 can include a curved wall forming a partial-circle or partial-ellipse cross-section. The cover body 115 can also include combinations of straight and curved sections.

The cover body 115 can extend the length of the telescoping base 45 or a portion of the length of the telescoping base 45. For example, when the telescoping base 45 is secured with handle mounts 50, 51, the cover body 115 can extend from the upper handle mount 51 to the lower handle mount 50 or between the upper handle mount 51 and the lower handle mount 50. The cover body 115 can also extend from a bottom side of the upper handle mount 51 to a bottom side of the lower handle mount 50. When the telescoping base 45 extends below the lower handle mount 50, the cover body 115 can also extend from a bottom side of the upper handle mount 51 to a bottom side of the telescoping base 45.

The cover body 115 can define first and second vertical edges 162, 163, and the vertical edges 162, 163 can rest against or proximate the back support 25 of the container body 20 when enclosing portions of the telescoping base 45. The cover body 115 can also enclose portions of one or both of the handle mounts 50, 51. In one arrangement, the cover body 115 can also include notches 160 in the first and second sidewall sections for receiving portions of the handle mount 50, as shown in FIGS. 1A and 2-8. The notches 160 can be positioned on an upper portion of the cover body 115 to correspond to an upper handle mount 51, on a lower portion of the cover body to correspond to a lower handle mount 50, or both. The notches 160 can include a notch in the first sidewall 117 and a matching notch in the second sidewall 118. The length and depth of the notches 160 can correspond to the approximate height (from top side to bottom side) of the handle mount 50, 51 to be enclosed and the approximate distance the handle mount 50, 51 horizontally extends from the back support 25 of the container body 20, respectively. The cover body 115 can also include a bottom wall 150 configured to cover a bottom side of the handle mount 50 or to cover a bottom side of the telescoping base 45 that may extend below the lower handle mount 50.

These features of the cover body 115 can provide a close and secure fit for maximized protection of the telescoping base 45.

The cover body 115 can be formed from or include suitable durable materials for protecting a telescoping handle from damage. For example, the cover body 115 can include metals such as steel and aluminum, thermoplastics such as high-density polyethylene (HDPE) and ultra-high-molecular-weight polyethylene (UHMWPE), and other polymers.

The cover body 115 includes an inner side. The inner side of the cover body 115 is shown in FIGS. 5-8 and is the side most proximate to the telescoping base 45 when the skid plate 100 is attached to the telescoping handle 40.

Figure 5:
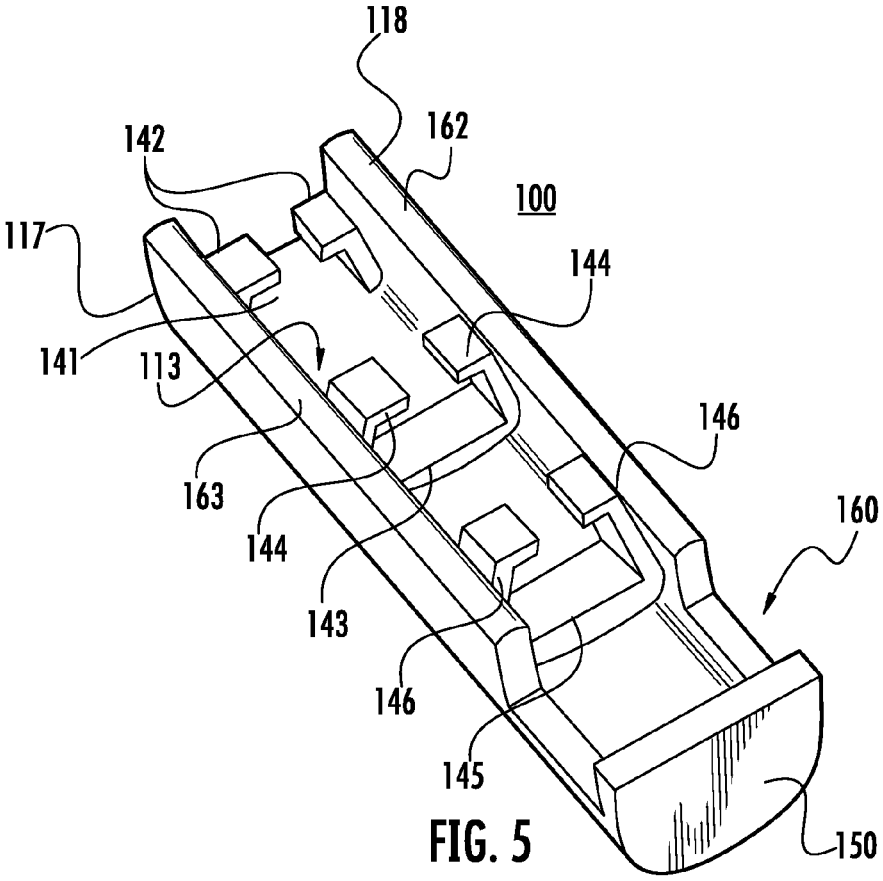
FIG. 5 is a perspective view of an inner side of the skid plate of FIG. 2.

The skid plate 100 can also include engagement members 120, 130 extending from the inner side of the cover body 115 for engaging with the telescoping base 45 of the telescoping handle 40. Engagement members can include clips, prongs, clamps, straps, belts, rings, bolts, screws, rivets and magnets. The engagement members 141-146 can be coupled to the inner side of the cover body 115 on the first and second sidewall sections 117, 118, on the back section 116, or both. Coupling to the inner side of the cover body 115 can include direct attachment to the inner side, such as engagement members 141-146 extending directly from the inner surface (for example, as shown in FIGS. 5 and 8); attachment to the cover body 115 contiguous with the inner side, such as engagement members 142, 144, 146 extending from or between edges 162, 163 of the cover body (for example, as shown in FIG. 9); or attachment through the cover body 115, such as engagement members 142, 144, 146 boring through the cover body 115 from the outer side to the inner side.

In one embodiment, the skid plate 100 can include one engagement member (e.g., 141 or 142). In other embodiments, the skid plate 100 can include a plurality of engagement members (e.g., 141-146) extending from the inner side of the cover body 115.

The plurality of engagement members 141-146 can include at least one attachment member 142, 144, 146 for securing the cover body 115 to the telescoping base 45. The plurality of engagement members 141-146 can also include at least one spacing member 141, 143, 145 for providing a space between the telescoping base 45 and the back section 116 of the inner side of the cover body 115.

Figure 6A:
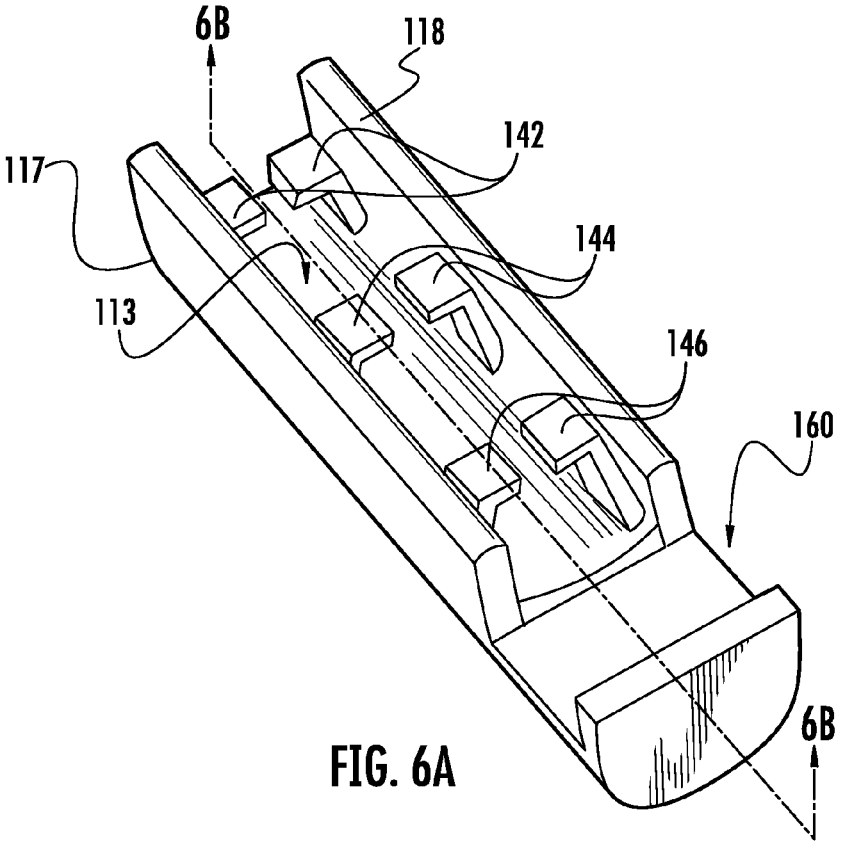
FIG. 6A is a perspective view of an inner side of another skid plate described herein.
Figure 7:
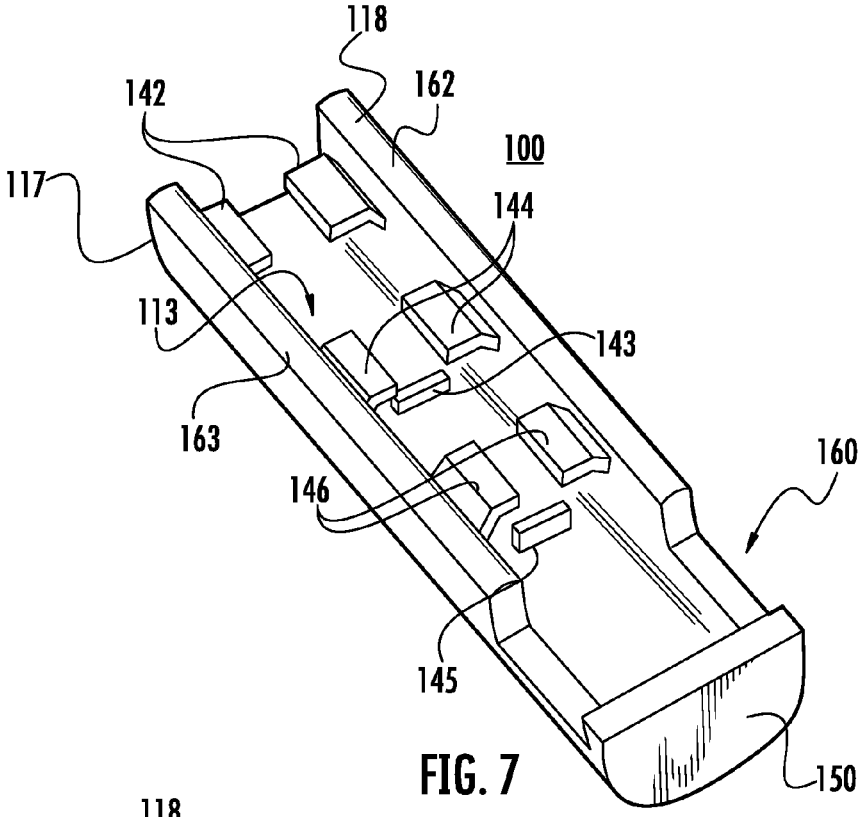
FIG. 7 is a perspective view of an inner side of another skid plate described herein.
Figure 8:
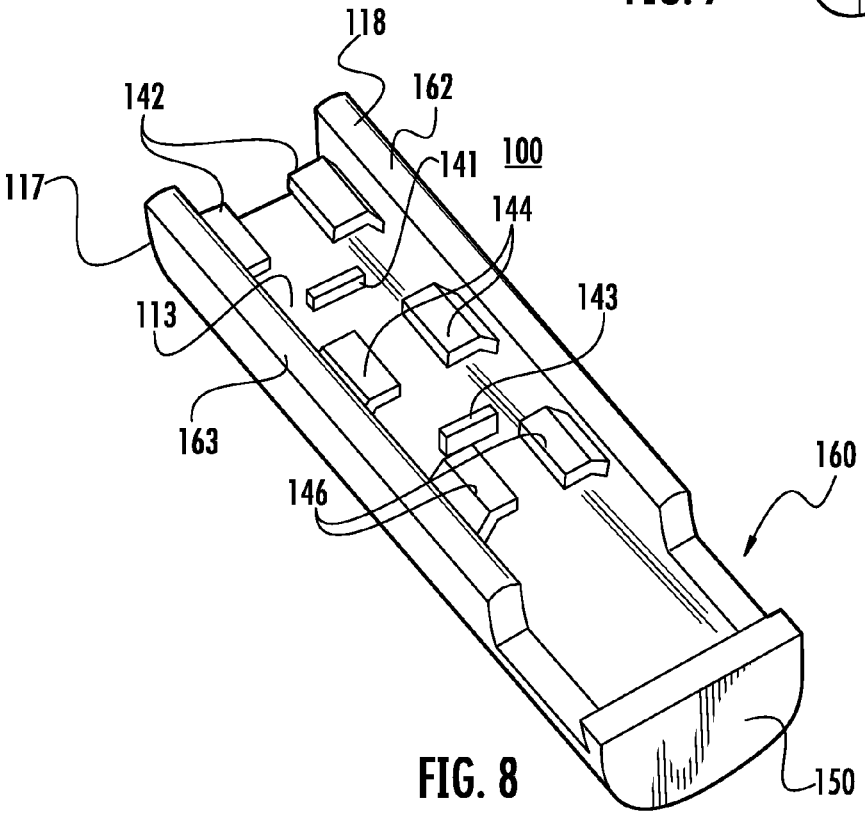
FIG. 8 is a perspective view of an inner side of another skid plate described herein.
Figure 9:
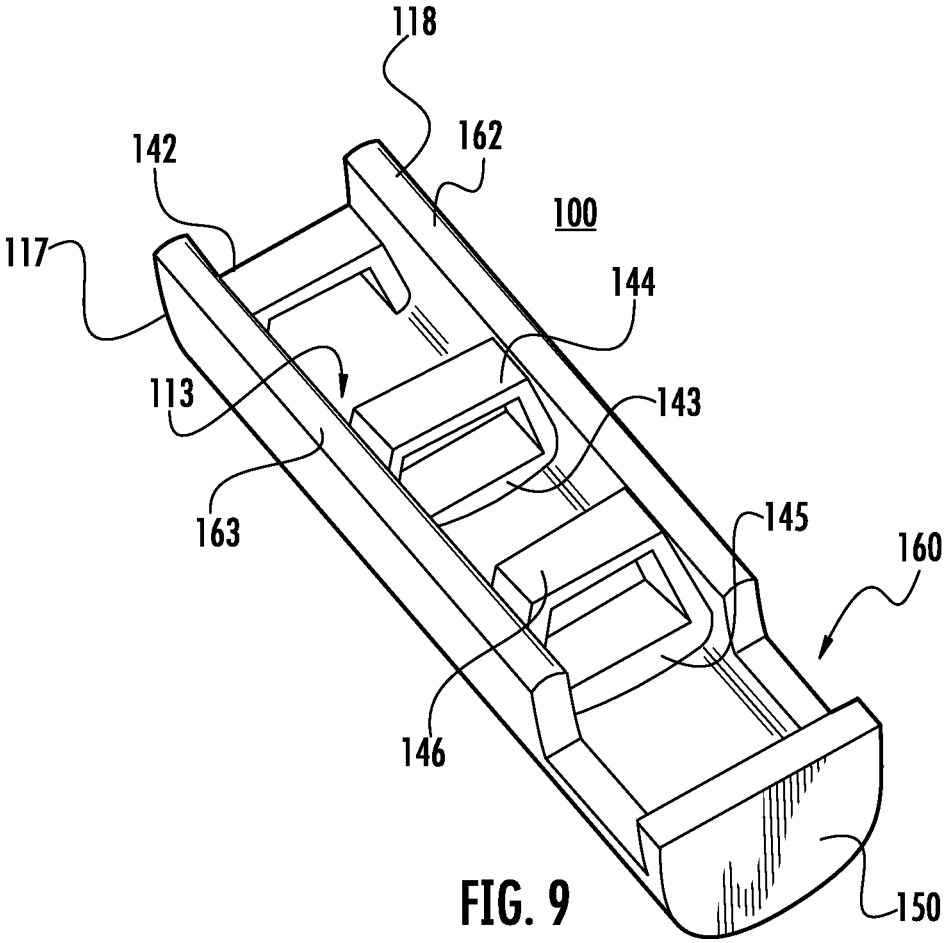
FIG. 9 is a perspective view of an inner side of another skid plate described herein.
Figure 10:
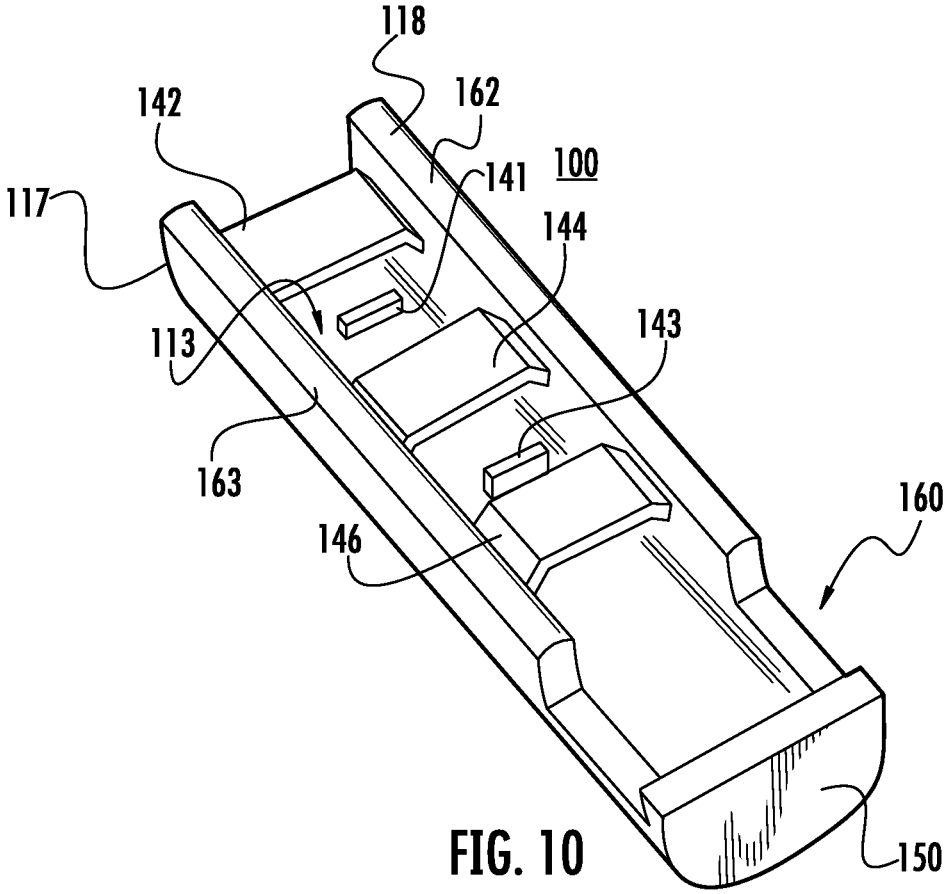
FIG. 10 is a perspective view of an inner side of another skid plate described herein.

As shown in FIGS. 7 and 8, the spacing members 141, 143, 145 can be coupled to the back section 116 of the cover body 115. The attachment members 142, 144, 146 can be coupled to the first and second sidewall sections 117, 118 of the cover body as shown in FIGS. 7 and 8; to the back section 116 as shown in FIG. 6A; or to spacing members 141, 143, 145 as shown in FIG. 5.

The spacing members 141, 143, 145 can be vertically spaced apart from the attachment members 142, 1441, 146 as shown in FIG. 8. The spacing members 141, 143, 145 can also be aligned vertically with corresponding attachment members 142, 144, 146, as shown in FIG. 6.

Spacing members can also be coupled to attachment members. For example as shown in FIG. 5, the engagement members can form open clips 141-146, each open clip having a clip base 141, 143, 145 and a set of prongs 142, 144, 146 extending from each clip base 141, 143, 145. The clip base, i.e. clip base 141, can be coextensive, e.g. flush, with the back section 116 of the inner side of the cover body 115 or can extend from the inner side at a certain elevation, e.g. clip bases 143, 145.

In another embodiment shown in FIG. 9, the engagement members can include closed clips 142, 144, 146, each clip 142, 144, 146 forming a polygonal or circular opening through which the telescoping base 45 can be received. The closed clips 142, 144, 146 can extend directly from the inner side of the cover body 115 or can be contiguous with the inner surface 113 of the cover body 115. The closed clips 120 can also include clip bases 141, 143, 145 that extend from the inner surface 113 at a certain elevation. In another embodiment shown in FIG. 10, the engagement members can include closed clips 142, 144, 146 and spacing members 141, 143, and the spacing members 141, 143 can be spaced apart from the closed clips 142, 144, 146.

Figure 11:
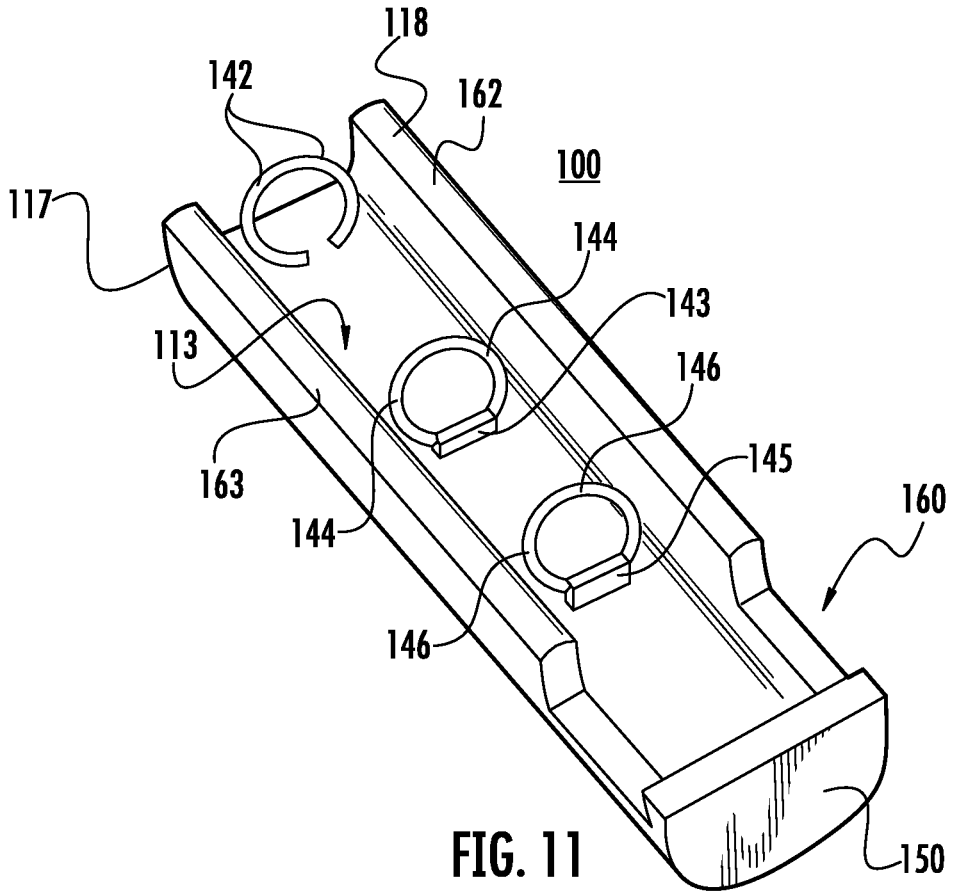
FIG. 11 is a perspective view of an inner side of another skid plate described herein.

In another embodiment shown in FIG. 11, the engagement members 142, 144, 146 can be straps for wrapping around the telescoping base 45. The straps can extend directly from the inner surface 113 of the cover body 115. The straps can also extend from spacing members 141, 143, 145 that extend from the inner side at a certain elevation.

In another embodiment, the engagement members 142, 144, 146 can include other fasteners such as bolts or screws for engaging with the telescoping base 45 to attach the skid plate 100 to the telescoping handle 40.

Figure 6B:
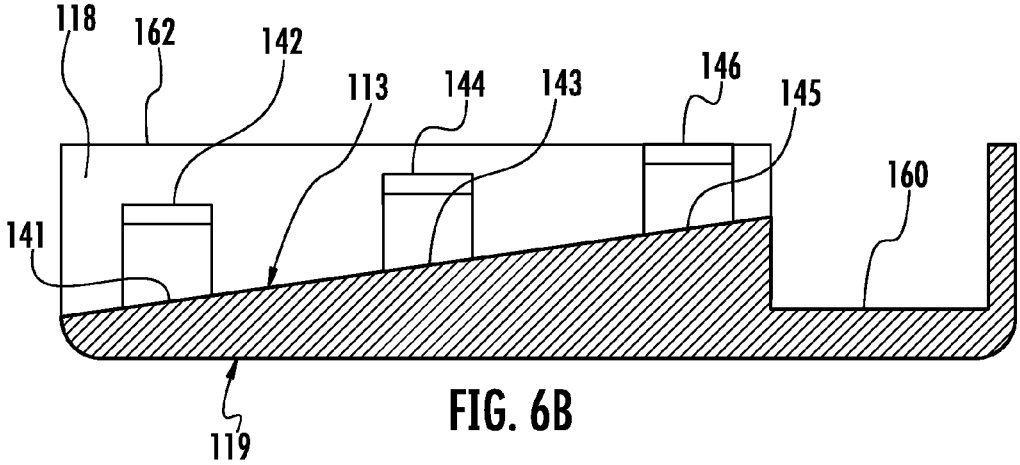
FIG. 6B is a cross-sectional view of the skid plate of FIG. 6A, along cut line 6B-6B.

The engagement members can also engage with the telescoping base to form a slope relative to the cover body 115. For example, as shown in FIGS. 7-11, the spacing members 141, 143, 145 can form a slope relative to the inner surface 113 of the cover body 115 by extending at different elevations. Alternately, as shown in FIG. 6B, the inner surface 113 itself can be sloped relative to the back section 116 of the outer surface 199 of the cover body 115. Example elevations can include, without limitation, 5 centimeters (cm), 2 cm, 1 cm, 8 mm, 5 mm, 1 mm, 0 mm, and any range in between these elevations.

The slope can be formed based on engagement members having a smaller elevation proximate the upper end of the skip plate 100 and progressively larger elevations toward the lower end of the skid plate 100. For example as shown in FIG. 5, the engagement members can include a first clip 141/142, a second clip 143/144 and a third clip 145/146. The second clip 143/144 can be disposed below the first clip 141/142, and the third clip 145/146 can be disposed below the second clip 143/144. The first clip base 141 can be coextensive with the back section 116 of the cover body 115, i.e. an elevation of zero. The second clip base 143 and the third clip base 145 can have elevations greater than zero, with the third clip base 145 extending from the cover body 115 further, i.e. at an elevation greater than, the second clip base 145.

The slope can also be formed by varying a thickness of the inner side of the cover body 115, as shown in FIGS. 6A and 6B. The attachment members 142, 144, 146 can be coupled the back section 116 of the inner side of the cover body 115 or to the first and second sidewall sections 117, 118 of the inner side of the cover body 115.

When the telescoping base 45 is secured with handle mounts 50, 51, the slope in the skid plate 100 can allow at least a portion of a handle mount 50, 51 to be enclosed and protected while also providing a relatively level outer surface of the skid plate 100 to facilitate dragging the container 10 by the handle 40 over impediments. For example, the slope can approximate the change in elevation from the telescoping base 45 to the handle mount 50.

A method of protecting a telescoping handle 40 is also described herein. The method can include the steps of providing a telescoping handle 40 with a telescoping base 45, providing a skid plate 100, and attaching the skid plate 100 to the telescoping handle 40. The skid plate 100 can include a cover body 115 including a back section 116, a first sidewall section 117 and a second sidewall section 118. The cover body 115 can define a concave cavity to enclose therein portions of the telescoping base 45. The skid plate 100 can be attached such that an inner side of the cover body 115 engages with the telescoping base 45.

The skid plate 100 can be attached to the telescoping handle 40 in any suitable way, including without limitation adhesives, welding, and engagement members. When the skid plate 100 includes a plurality of engagement members 141-146 extending from the inner side of the cover body 115, the step of attaching the skid plate 100 to the telescoping handle 40 can also include engaging the plurality of engagement members 141-146 with the telescoping base 45.

When the telescoping base 45 is secured with upper and lower handle mounts 50, 51, the step of attaching the skid plate 100 to the telescoping handle 40 can also include attaching the skid plate 100 below the upper handle mount 51 and enclosing at least a portion of the lower handle mount 50. The plurality of engagement members 141-146 can also include at least two attachment members 142, 144, 146 and at least one spacing member 141, 143, 145. The step of attaching the skid plate 100 to the telescoping handle 40 can also include engaging one of the attachment members 142, 144, 146 with the telescoping base 45 proximate a bottom side of the upper handle mount 51, engaging another of the attachment members 142, 144, 146 with the telescoping base 45 proximate to a top side of the lower handle mount 50, and enclosing at least a portion of the lower handle mount 50 with the cover body 115. The at least one spacing member 141, 143, 145 can provide a space between the telescoping base 45 and the container 10 and forms a slope to accommodate enclosing at least a portion of the lower handle mount 50 with the cover body 115.

Accordingly, a rolling container 10 can include a container body 20, at least one wheel 30, a telescoping handle 40, and a skid plate 100 as described herein. The rolling container 10 can also include a telescoping handle 40 with a pair of telescoping bases, and a skid plate 100 can be attached to each telescoping base 45.

EXAMPLES

The skid plate described herein provides a rolling container with exceptional durability, even when heavy loads are stored and transported in the container body. In one experiment, a rolling bag, such as shown in FIG. 1A, was loaded with 100 pounds of tools. The telescoping handle was fully extended, and then the tool bag was pulled by the handle up a flight of concrete stairs 5 times. The skid plate incurred damage including scraping due to contact with the sharp edges of the concrete stairs. However, the telescoping handle was not damaged and continued to extend and retract properly. Removing the skid plate demonstrated that the apparatus protected the telescoping base of the handle, which did not show any damage. In contrast, the telescoping handle of the same rolling bag without the skid plate has been rendered inoperable under less extreme conditions. In particular, damage to the telescoping handle without skid plates prevented the telescoping handle from retracting properly.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A skid plate for protecting a telescoping handle, said skid plate comprising:

a cover body comprising a back section, a first sidewall section, and a second sidewall section on a side of said back section opposite said first sidewall section, said cover body defining a concave cavity to enclose therein portions of a telescoping base of a telescoping handle; and a plurality of engagement members, comprising some engagement members extending from an inner side of said first sidewall section toward said second sidewall section, and a plurality of other engagement members extending from an inner side of said second sidewall toward said first sidewall section, each of said engagement members and other engagement members adapted for engaging with a telescoping base, wherein said cover body comprises an opening at a top end, and wherein at least one of said first sidewall section and said second sidewall section include a notch cut-out proximate a bottom end opposite said top end.

2. A rolling container comprising:

a container body comprising a bottom support and a back support;

at least one wheel attached to said container body proximate at least one of said bottom support and back support;

a telescoping handle attached to at least a portion of said back support; and a skid plate according to claim 1 coupled to said telescoping handle.

3. The rolling container of claim 1, wherein said plurality of engagement members are coupled to said first and second sidewall sections of said cover body.

4. The rolling container of claim 1, wherein said plurality of engagement members are coupled to said back section of said cover body.

5. The rolling container of claim 1, said plurality of engagement members comprising at least one attachment member for securing said cover body to said telescoping base and at least one spacing member for providing a space between said telescoping base and said back section of said inner side of said cover body.

6. The rolling container of claim 5, wherein said at least one spacing member is coupled to said back section of said cover body, and said at least one attachment member is coupled to said first and second sidewall sections of said cover body.

7. The rolling container of claim 6, wherein said at least one attachment member further comprises a first attachment member and a second attachment member; said first and second attachment members are spaced apart; and said at least one spacing member is disposed between said first and second attachment members.

8. The rolling container of claim 5, wherein said at least one spacing member is coupled to said back section of said cover body, and said at least one attachment member is coupled to said at least one spacing member.

9. The rolling container of claim 1, further comprising a handle mount for attaching said telescoping base to said back support of said container body; wherein said cover body encloses portions of said handle mount.

10. The rolling container of claim 9, wherein said notch cut-out is adapted for receiving portions of said handle mount.

11. The rolling container of claim 1, further comprising an upper handle mount and a lower handle mount for attaching said telescoping base to said back support of said container body;

wherein said cover body extends from a bottom side of said upper handle mount to a bottom side of said lower handle mount and encloses a portion of said lower handle mount;

said plurality of engagement members comprise attachment members for securing said cover body to said telescoping base and spacing members forming a slope and providing a space between said telescoping base and said back section of said inner side of said cover body.

12. The skid plate of claim 1, wherein a lateral cross-section of said cover body is curvilinear.

13. The skid plate of claim 1, wherein a lateral cross-section of said cover body is rectilinear.

14. A method of protecting a telescoping handle comprising the steps of:

providing a telescoping handle comprising a telescoping base;

providing a skid plate according to claim 1; and attaching said skid plate to said telescoping handle, wherein an inner side of said cover body engages with said telescoping base.

15. The skid plate of claim 1, wherein said opening is adapted to allow another portion of the telescoping handle to extend through the opening in the top end.

16. The skid plate of claim 1, wherein each of said first sidewall section and said second sidewall section include a notch cut-out proximate the bottom wall.

17. The skid plate of claim 16, wherein said notch cut outs align with one another.

18. The skid plate of claim 1, wherein said cover body further comprises a bottom wall at the bottom end.

19. A skid plate for protecting a telescoping handle, said skid plate comprising:

a cover body comprising a back section, a first sidewall section, and a second sidewall section on a side of said back section opposite said first sidewall section, said cover body defining a concave cavity to enclose therein portions of a telescoping base of a telescoping handle; and a plurality of engagement members, comprising some engagement members extending from an inner side of said first sidewall section toward said second sidewall section, and a plurality of other engagement members extending from an inner side of said second sidewall toward said first sidewall section, each of said engagement members and other engagement members adapted for engaging with a telescoping base, said plurality of engagement members and other engagement members comprising a first clip and a second clip forming a slope relative to said cover body;

wherein said first clip comprises a first clip base coextensive with said back section of said cover body and a first set of prongs extending from said first clip base for securing said cover body to a telescoping base; and said second clip comprises a second clip base coupled to said back section of said cover body and a second set of prongs extending from said second clip base for securing said cover body to a telescoping base.

20. The skid plate of claim 19, wherein:

wherein said plurality of engagement members and other engagement members further comprise a third clip with a third clip base coupled to said back section and a third set of prongs extending from said third clip base;

wherein said second clip is disposed below said first clip and said third clip is disposed below said second clip; and said third clip base extends from said inner side of said cover body further than said second clip base.

* * * * *